US011299679B2

(12) United States Patent
Eatough

(10) Patent No.: US 11,299,679 B2
(45) Date of Patent: Apr. 12, 2022

(54) COKE PROCESSING ENERGY PRODUCTION

(71) Applicant: EKOMATTER IP HOLDINGS 2 LLC, Salt Lake City, UT (US)

(72) Inventor: Craig Eatough, Provo, UT (US)

( * ) Notice: Subject to any disclaimer, the term of this patent is extended or adjusted under 35 U.S.C. 154(b) by 134 days.

(21) Appl. No.: 16/337,000

(22) PCT Filed: Jul. 18, 2017

(86) PCT No.: PCT/US2017/042483
§ 371 (c)(1),
(2) Date: Mar. 27, 2019

(87) PCT Pub. No.: WO2019/017889
PCT Pub. Date: Jan. 24, 2019

(65) Prior Publication Data

US 2021/0032543 A1 Feb. 4, 2021

(51) Int. Cl.
*C10B 53/04* (2006.01)
*C10B 57/04* (2006.01)
*C10K 1/00* (2006.01)

(52) U.S. Cl.
CPC ..... *C10B 53/04* (2013.01); *C10B 57/04* (2013.01); *C10K 1/002* (2013.01)

(58) Field of Classification Search
CPC ..... C10B 53/04; C10B 57/04; C10K 1/002
See application file for complete search history.

(56) References Cited

U.S. PATENT DOCUMENTS 4,127,391 A * 11/1978 Koppelman ..... C10L 9/00 201/21
4,370,201 A * 1/1983 Lowenhaupt ..... G01N 33/222 201/1
7,785,447 B2 * 8/2010 Eatough ..... C10L 5/28 201/6
8,287,696 B2 * 10/2012 Kramer ..... C10B 57/04 201/1
8,585,788 B2 * 11/2013 Drozd ..... C10L 5/361 44/620
8,877,015 B2 * 11/2014 Bartek ..... C10L 1/02 201/1
9,045,696 B2 * 6/2015 Rugg ..... C10B 53/02
9,068,123 B2 * 6/2015 Kramer ..... F02C 3/28
10,968,395 B2 * 4/2021 Quanci ..... C10B 57/04
2008/0116052 A1 * 5/2008 Eatough ..... C10L 5/28 201/6
2009/0272028 A1 * 11/2009 Drozd ..... F23K 1/00 44/569
2010/0139287 A1 * 6/2010 Kramer ..... C10B 15/02 60/781
2012/0160658 A1 * 6/2012 Bartek ..... C10L 1/02 201/1

(Continued)

*Primary Examiner* — Jonathan Miller

(57) ABSTRACT

A method is disclosed, for producing coke in which at least a first and second source of carbonaceous materials are introduced as feedstock into a mixer. The materials are mixed into a single feedstock, and the single feedstock is analyzed to determine its coking feasibility. The single feedstock is pyrolyzed in a pyrolyzer to produce at least a coke material and a gaseous by-product. At least a portion of the gaseous by-product is used outside of the pyrolyzer. Other embodiments are also disclosed.

12 Claims, 3 Drawing Sheets

(56) References Cited

U.S. PATENT DOCUMENTS

| | | | | |
|---|---|---|---|---|
| 2012/0238645 | A1* | 9/2012 | Rudlinger | F01K 13/00 518/700 |
| 2013/0008771 | A1* | 1/2013 | Kramer | C10G 2/32 201/1 |
| 2013/0277198 | A1* | 10/2013 | Rugg | C10L 9/08 201/27 |
| 2016/0186063 | A1* | 6/2016 | Quanci | C10L 5/04 201/8 |
| 2020/0346929 | A1* | 11/2020 | Cagigas | B01D 53/14 |

* cited by examiner

COKE PROCESSING ENERGY PRODUCTION

BACKGROUND OF THE INVENTION

1. Technical Field

The present invention relates generally to coke processing, and, more specifically, to energy production for multiple sources as part of a coke processing method.

2. Description of the Related Art

Various coke processing methods are known in the art. For example, U.S. Pat. No. 7,785,447 issued to Eatough et. al., discloses concepts related to clean coke processing such as continuously producing a high-grade of coke from low-grade materials without causing a pollution problem.

In addition, the International Journal of Coal Geology points out that CSR (Coke Strength after Reaction) and CRI (Coke Reactivity Index) indices may be used to indicate coke strength in traditional coke processing methods; e.g., high quality coke means CRI is low and CSR is high.

The following disclosure relates to further improvements in the art; non-obvious improvements, as demonstrated by the failure of those of ordinary skill in the art to implement such improvements after having available the benefit of these earlier coking disclosures.

SUMMARY

It has been discovered that at least the aforementioned challenges are resolved by a method as disclosed herein. Upon viewing the present disclosure, one of ordinary skill in the art will appreciate that variations of principles according to the present invention could be contemplated.

For example, in one inventive embodiment, a method for producing coke starts with a mixer where a first source of carbonaceous material is used as a first feedstock, and a second source of carbonaceous material is added as a second feedstock. The first and second source carbonaceous materials are mixed into a single feedstock of carbonaceous materials.

The single feedstock is pyrolyzed in a pyrolyzer to produce coke material. A gas by-product is harnessed during the pyrolyzing, and if necessary is treated before supplying at least a portion of it to an energy provider outside of the pyrolyzer.

The method may include the first source of carbonaceous material being coal fines, and the second source of carbonaceous material being coke waste fines. It should be noted that a third source of material could be added to the mixture.

Of note, the method also includes pyrolyzing the single feedstock of carbonaceous material to produce a high-grade coke material.

In certain embodiments, the method uses a single feedstock that has a particular composition, a particular reactivity, a particular shape, a particular by-product generation, a particular size, a particular strength, and/or a particular heating value.

In another inventive embodiment, a method is disclosed for producing coke that includes mixing at least a first and a second carbonaceous material into a single feedstock of carbonaceous materials.

The coking feasibility of the single feedstock of carbonaceous materials is determined and the feedstock is modified into a predetermined material composition where it is pyrolyzed in a pyrolyzer to produce coke material and coke by-products that are used outside of the pyrolyzer.

As in the earlier embodiment, the predetermined material composition may have a particular shape, a particular by-product generation, a particular composition, a particular reactivity, a particular size, a particular strength, and/or a particular heating value.

In this embodiment, the coke by-products that are used outside the pyrolyzer include gas.

In a further embodiment, a method is disclosed for producing coke which a first source of carbonaceous material is introduced as a first feedstock into a mixer, and a second source of carbonaceous material introduced as a second feedstock into the mixer.

At least the first and second source carbonaceous materials are mixed into a single feedstock of carbonaceous materials, and the single feedstock of carbonaceous materials is analyzed to determine its coking feasibility.

The single feedstock is pyrolyzed in a pyrolyzer to produce at least a coke material and a gaseous by-product. At least a portion of the gaseous by-product is used outside of the pyrolyzer.

In the current inventive embodiment, the gaseous by-product is treated to remove impurities.

In addition, the single feedstock of carbonaceous material may be modified into a predetermined material composition. This predetermined composition may also have a particular reactivity, a particular shape, a particular size, a particular composition, a particular strength, a particular heating value, and/or a particular size.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

The present invention may be better understood, and its numerous objects, features, and advantages made apparent to those skilled in the art by referencing the accompanying drawings.

DETAILED DESCRIPTION

Figure 1:
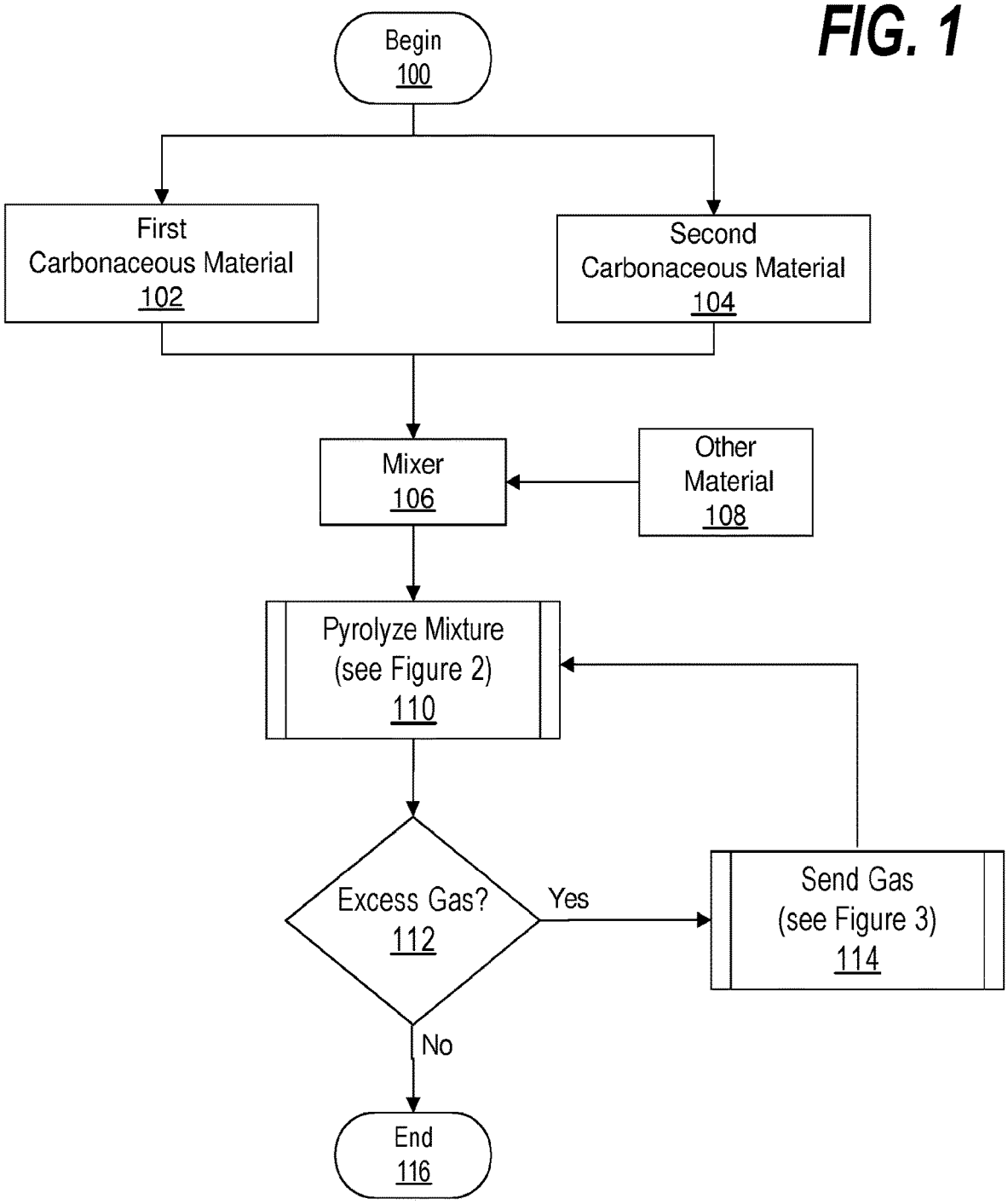
FIG. 1 is a flow diagram showing an embodiment of a coking process according to principles of the present invention.

The following provides a detailed description of examples of the present invention and should not be taken to be limiting of the invention itself. Rather, any number of variations may fall within the scope of the invention, which is defined in the claims following this detailed description.

Reference will now be made in detail to embodiments of the invention illustrated in accompanying drawings. Whenever possible, the same or similar reference numerals are used in the drawings and the description to refer to the same of like parts, acts, or steps. The drawings are in simplified form.

Those of ordinary skill in the art will appreciate that in the development of any such actual implementation, as in any engineering or design project, numerous implementation-specific decisions must be made to achieve the developer's specific goals, such as compliance with system-related, metallurgical-related constraints, which may vary from one implementation to another. Such would be a routine undertaking of design, fabrication, and manufacture for those of ordinary skill in the art and having the benefit of the present disclosure.

These coke processes do not require high-quality coking coals, nor are they limited to only two inputs of carbonaceous materials. Further, the disclosed processes use feedstock material more efficiently because "waste" products or fines may be used to create high-quality coke and thereby, among other things, contribute to what is environmentally friendly coke production. In addition, energy savings are recognized at least in part due to the reduced time required to produce this high-quality coke.

Coal blending for coke production varies in the number of coals used. It also varies with the proportion, rank, coking properties, and geographical or the coal components. Coal selection and blend composition are major factors controlling physical and chemical coal properties. These factors contribute to what is sometimes referred as devolatilization behavior.

As aids to coal selection for coke quality predictions, several mathematical models are available. These can be divided into two groups. The first group of models focuses on the prediction of cold mechanical, metallurgical, or "met" coke strength.

The second group of models uses the CSR and CRI indices as coke quality parameters. At this writing, no universal prediction model has been recognized, especially for custom coke production. Some coals or blends show significant deviations between prediction results based on a model and actual use.

Of note, almost all of today's coking plants use some sort of a model to try to predict coal rank, petrology, rheological properties, and ash chemistry. However, unlike the presently disclosed inventive embodiments, batteries of heat-recovery ovens are needed to attempt to accomplish the results predicted by the models. To attempt to operate in environmentally friendly modes, the ovens have begun to operate under suction with no emissions during the coking process.

FIG. 1 is a flow diagram showing an embodiment of a coking process according to principles of the present invention.

In the illustrated embodiment, the process begins at oval 100. After oval 100, a first and a second process block 102, 104 are illustrated as combining carbonaceous materials a mixer at mixer block 106.

Other materials are then added at process block 108. These other materials may or may not be carbonaceous. Whatever the mixture, in certain embodiments, the mixture may be customized for a future pyrolyzation step where coke is formed. As indicated at process block 110, pyrolyzation of the mixture begins where the process is detailed in FIG. 2.

If excess gas is found during pyrolyzation, decision block 112 indicates that "Yes" branch is taken and gas is sent elsewhere as indicated by process block 114. Details of the process for dealing with excess gas are found in FIG. 3.

Otherwise, process block 114 is skipped and the method moves to oval 116 where the flow diagram of FIG. 1 comes to an end and the disclosed coke processing has completed.

Figure 2:
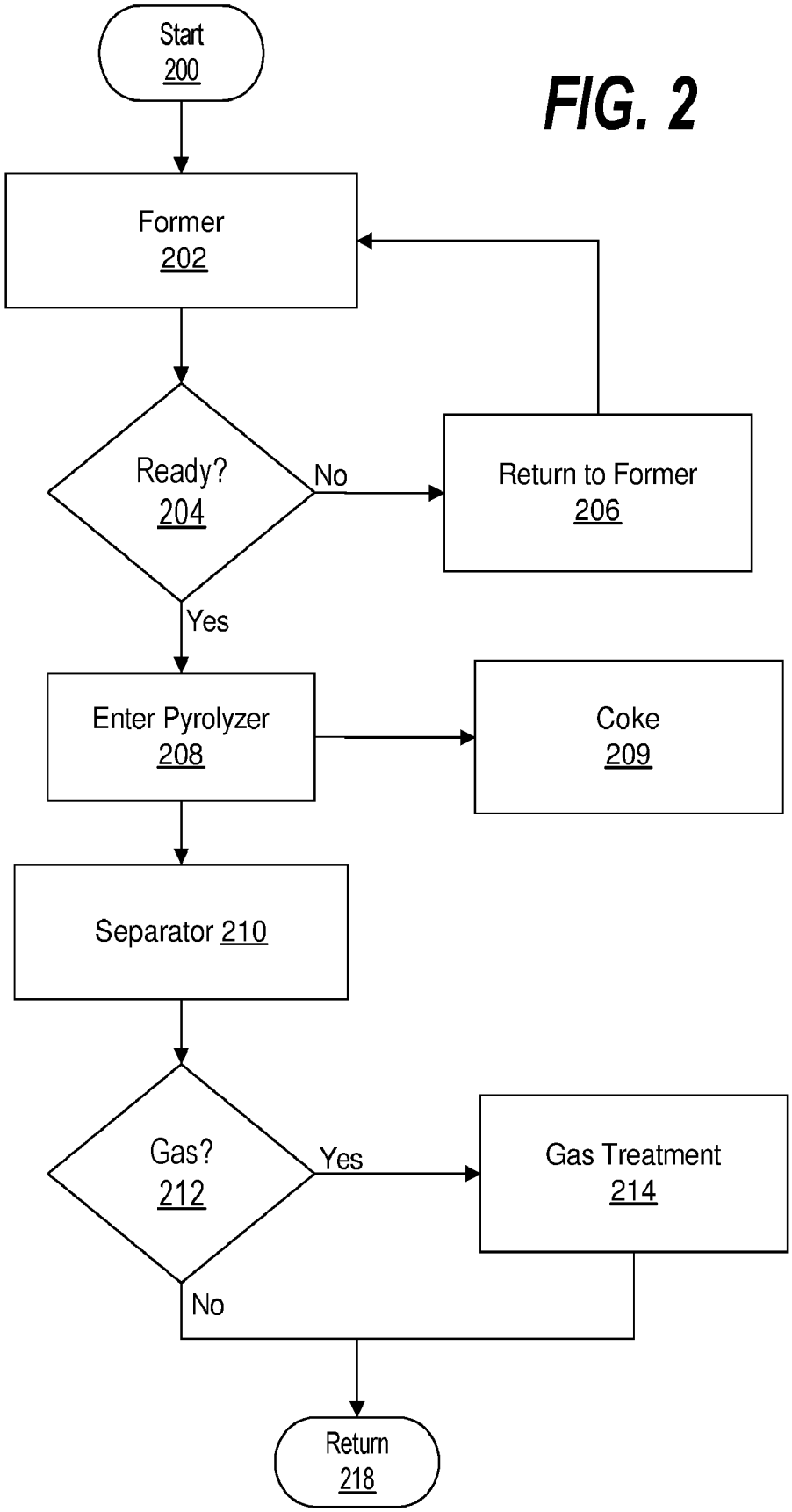
FIG. 2 is a flow diagram showing a pyrolyzation process from the process illustrated in FIG. 1.

FIG. 2 is a flow diagram showing details of a pyrolyzation process represented by process block 110 illustrated in FIG. 1. The pyrolyzation method of FIG. 2 begins at oval 200. Process block 202 indicates that the mixture is prepared, or "formed" for pyrolyzation.

If it is determined that the mixer ingredients are not ready for pyrolyzation, as indicated at decision block 204, "No" branch is taken and the mixer ingredients are returned through process block 206 to process block 202 for further forming.

Once decision block 204 indicates that the mixer ingredients are ready for pyrolyzation, "Yes" branch of decision block 204 is taken and the mixer ingredients enter pyrolyzation process block 208 to produce coke at process block 209.

In addition, separator 210 is illustrated where the pyrolyzed mixture may be separated into tars and gases. Decision block 212 is the step where it is decided if useable gases are present. If so, "yes" branch is taken and gas treatment process block 214 is entered.

Alternatively, or in addition, if "no" branch is taken, the mixture completes processing and moves to oval 218 which indicates that the method returns to FIG. 1.

Upon viewing the present disclosure, those of ordinary skill in the art will appreciate that other equivalent materials and steps could be substituted to realize the presently disclosed invention.

Figure 3:
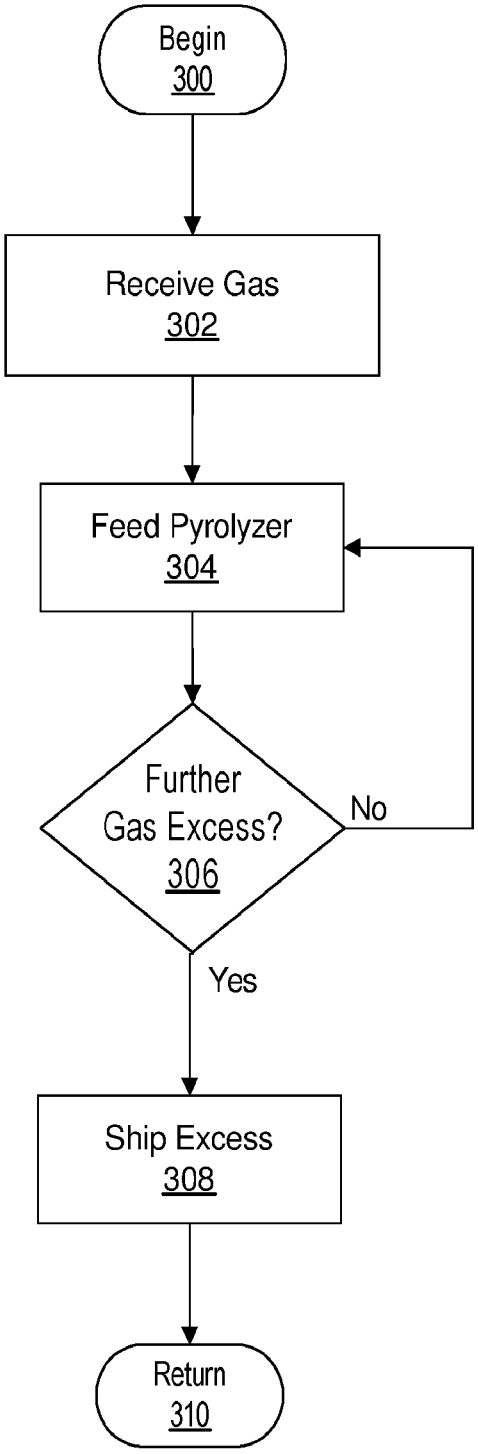
FIG. 3 is a flow diagram showing a process for usage of gas that may be produced according to the method of FIG. 2.

FIG. 3 is a flow diagram showing a process for usage of gas that may be produced according to the method of FIG. 2.

If more gas is produced than can be used to further power the pyrolyzation process of FIG. 2, then this excess gas is used for some other useful purpose. As indicated by oval 300, the process of FIG. 3 begins. Treated gas is received at process block 302 and fed to pyrolyzer block 304.

This gas is returned to process block 304 until an excess of gas is found. When decision block 306 indicates that "yes" branch will be taken because an excess of treated gas is found, this excess gas will be shipped to an outside energy provider as indicated by process block 308.

After this, the method of FIG. 3 completes at oval 310 where the method returns to FIG. 1.

Although various disclosure embodiments have been described in the foregoing detailed description and illustrated in the accompanying drawings, it will be understood that the presently disclosed invention is not limited to the embodiments disclosed, but indeed may assume numerous arrangements, re-arrangements, modifications, and substitutions of elements or steps without departing from the spirit and intended scope of the invention herein set forth. The appended claims are to encompass within their scope all such changes and modifications as are within the true spirit and scope of this invention.

Furthermore, it is to be understood that the invention is solely defined by the appended claims. It will be understood by those with skill in the art that if a specific number of an introduced claim element is intended, such intent will be explicitly recited in the claim, and in the absence of such recitation no such limitation is present.

For a non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more"

or "at least one" and indefinite articles such as "a" or "an"; the same holds true for the use in the claims of definite articles.

What is claimed is:

1. A method for producing coke comprising:

introducing a first source of carbonaceous material as a first feedstock into a mixer;

introducing a second source of carbonaceous material as a second feedstock into the mixer;

mixing at least the first source of carbonaceous material and the second source carbonaceous materials into a single feedstock of carbonaceous materials;

pyrolyzing said single feedstock in a pyrolyzer to produce coke material;

harnessing a gas by-product from said pyrolyzing, the gas by-product being utilized in the pyrolyzer to provide energy to the pyrolyzer, the gas by-product being analyzed to determine if excess gas by-product is provided from the pyrolyzer and, if so, the excess gas by-product being supplied to an energy provider outside of the pyrolyzer; and treating said gas before supplying at least a portion of it to the energy provider outside of the pyrolyzer.

2. The method of claim 1 wherein the first source of carbonaceous material is coal fines.

3. The method of claim 1 wherein the second source of carbonaceous material is coke waste fines.

4. The method of claim 1 wherein the third source of material is added to the mixture.

5. The method of claim 1 wherein said pyrolyzing the single feedstock of materials comprise the act of producing a metallurgical coke.

6. The method of claim 1 wherein the predetermined material composition is selected from the group consisting of a particular composition;

a particular reactivity;

a particular shape;

a particular by-product generation;

a particular size;

a particular strength; and a particular heating value.

7. A method for producing coke comprising:

mixing at least a first carbonaceous material and a second carbonaceous material into a single feedstock of carbonaceous materials;

determining coking feasibility of said single feedstock of carbonaceous materials;

modifying said single feedstock into a predetermined material composition; and pyrolyzing said customized single feedstock in a pyrolyzer to produce coke material and coke by-products that are used outside of the pyrolyzer, the gas by-product being utilized in the pyrolyzer to provide energy to the pyrolyzer, the gas by-product being analyzed to determine if excess gas by-product is provided from the pyrolyzer and, if so, the excess gas by-product being supplied to an energy provider outside of the pyrolyzer.

8. The method of claim 7 wherein the predetermined material composition is selected from the group consisting of a particular shape;

a particular by-product generation;

a particular composition;

a particular reactivity;

a particular size;

a particular strength; and a particular heating value.

9. The method of claim 7 wherein the coke by-products that are used outside the pyrolyzer include gas.

10. A method for producing coke comprising:

introducing a first source of carbonaceous material as a first feedstock into a mixer;

introducing a second source of carbonaceous material as a second feedstock into the mixer;

mixing at least the first source of carbonaceous material and the second source carbonaceous materials into a single feedstock of carbonaceous materials;

analyzing said single feedstock of carbonaceous materials to determine coking feasibility of the single feedstock of carbonaceous material;

customizing said single feedstock into a predetermined material composition; and pyrolyzing said single feedstock in a pyrolyzer to produce at least a coke material and a gaseous by-product, the gaseous by-product being utilized in the pyrolyzer to provide energy to the pyrolyzer, the gaseous by-product being analyzed to determine if excess gas by-product is provided from the pyrolyzer and, if so, the excess gas by-product being supplied to an energy provider outside of the pyrolyzer.

11. The method of claim 10 wherein the gaseous by-product is treated to remove impurities.

12. The method of claim 10 wherein the single feedstock of carbonaceous material is modified into a predetermined material composition selected from the group consisting of a particular reactivity, a particular shape, a particular size, a particular composition, a particular strength, a particular heating value, and a particular size.

* * * * *